US006098433A

United States Patent [19]

Maniaci

[11] Patent Number: 6,098,433

[45] Date of Patent: Aug. 8, 2000

[54] LOCK FOR SAFES AND OTHER SECURITY DEVICES

[75] Inventor: Anthony Charles Maniaci, Victorville, Calif.

[73] Assignee: American Security Products Company, Fontana, Calif.

[21] Appl. No.: 09/053,965

[22] Filed: Apr. 2, 1998

[51] Int. Cl.[7] ..... E05B 49/00

[52] U.S. Cl. ..... 70/278.1; 70/278.7; 70/333 R; 70/416; 292/144

[58] Field of Search ..... 70/278.1, 278.7, 70/279.1, 283, 333 R, 1.5, 416, 417, 465, 423, 424; 292/DIG. 65, 144

[56] References Cited

U.S. PATENT DOCUMENTS

| | | | |
|---|---|---|---|
| 18,157 | 9/1857 | Perry | 70/1.5 |
| 1,431,571 | 12/1922 | Daly | 292/2 |
| 3,799,596 | 3/1974 | Nozomu et al. | 292/DIG. 22 |
| 3,921,541 | 11/1975 | Chartrand et al. | 109/59 R |
| 3,990,531 | 11/1976 | Register | 292/DIG. 22 |
| 4,080,810 | 3/1978 | Fishman | 292/137 |
| 4,147,044 | 4/1979 | Bernath | 70/1.5 |
| 4,249,469 | 2/1981 | Craske | 109/59 R |
| 4,470,275 | 9/1984 | Fisher | 70/1.5 |
| 4,520,736 | 6/1985 | Crosby et al. | 70/1.5 |
| 4,552,399 | 11/1985 | Atarashi | 292/DIG. 22 |
| 4,648,255 | 3/1987 | Gartner | 70/1.5 |
| 4,679,415 | 7/1987 | Spratt | 70/1.5 |
| 4,904,984 | 2/1990 | Gartner et al. | 70/333 R X |
| 4,926,664 | 5/1990 | Gartner et al. | 70/278.7 X |
| 5,033,282 | 7/1991 | Gartner et al. | 70/278.7 |
| 5,246,258 | 9/1993 | Kerschenbaum et al. | 70/279.1 X |
| 5,249,831 | 10/1993 | Maniaci | 292/144 |
| 5,339,662 | 8/1994 | Goldman | 70/278.7 |
| 5,473,922 | 12/1995 | Bair et al. | 70/333 R X |
| 5,592,838 | 1/1997 | Clark et al. | 70/333 R X |
| 5,617,082 | 4/1997 | Denison et al. | 340/825.31 |
| 5,632,170 | 5/1997 | Evans | 70/333 R X |
| 5,881,589 | 3/1999 | Clark et al. | 70/333 R X |
| 5,887,467 | 3/1999 | Butterweck et al. | 70/278.7 |
| 5,893,283 | 4/1999 | Evans et al. | 70/333 R X |

FOREIGN PATENT DOCUMENTS

| | | | |
|---|---|---|---|
| 1039879 | 9/1958 | Germany | 292/244 |

*Primary Examiner*—Suzanne Dino Barrett
*Attorney, Agent, or Firm*—F. Eugene Logan

[57] ABSTRACT

A lock for safes and other security devices is disclosed having a case mountable on the inside of a safe door. A locking bolt in a slidable relationship within an opening in the case, moves between locked and unlocked positions. A gate, constrained in slidable relationship by and with the locking bolt, normally prevents the locking bolt from moving out of the locked position. An internal case extension obstructs the gate, when the lock is not activated, preventing the locking bolt from moving towards the unlocked position. A camming member, pivotally attached to the locking bolt, repositions the gate allowing the locking bolt to move out of the locked position. A solenoid driven armature, linked to the camming member and connected to the locking bolt, pivots the camming member and moves the locking bolt to the unlocked position. The locking bolt is held in the locked position when not activated by a spring. The solenoid is activated by an electrical unit having a keypad assembly mounted on the outside of the safe door. Coded input from the keypad assembly is wire fed through a small hole in the door to a receiver unit in the case that controls the solenoid. A novel relock member prevents the locking bolt from traveling to the unlocked position if the lock is tampered with through the small hole in the safe door.

17 Claims, 8 Drawing Sheets

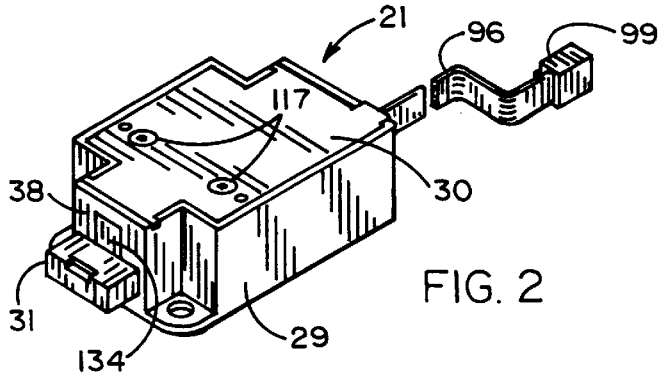
FIG. 2
FIG. 3
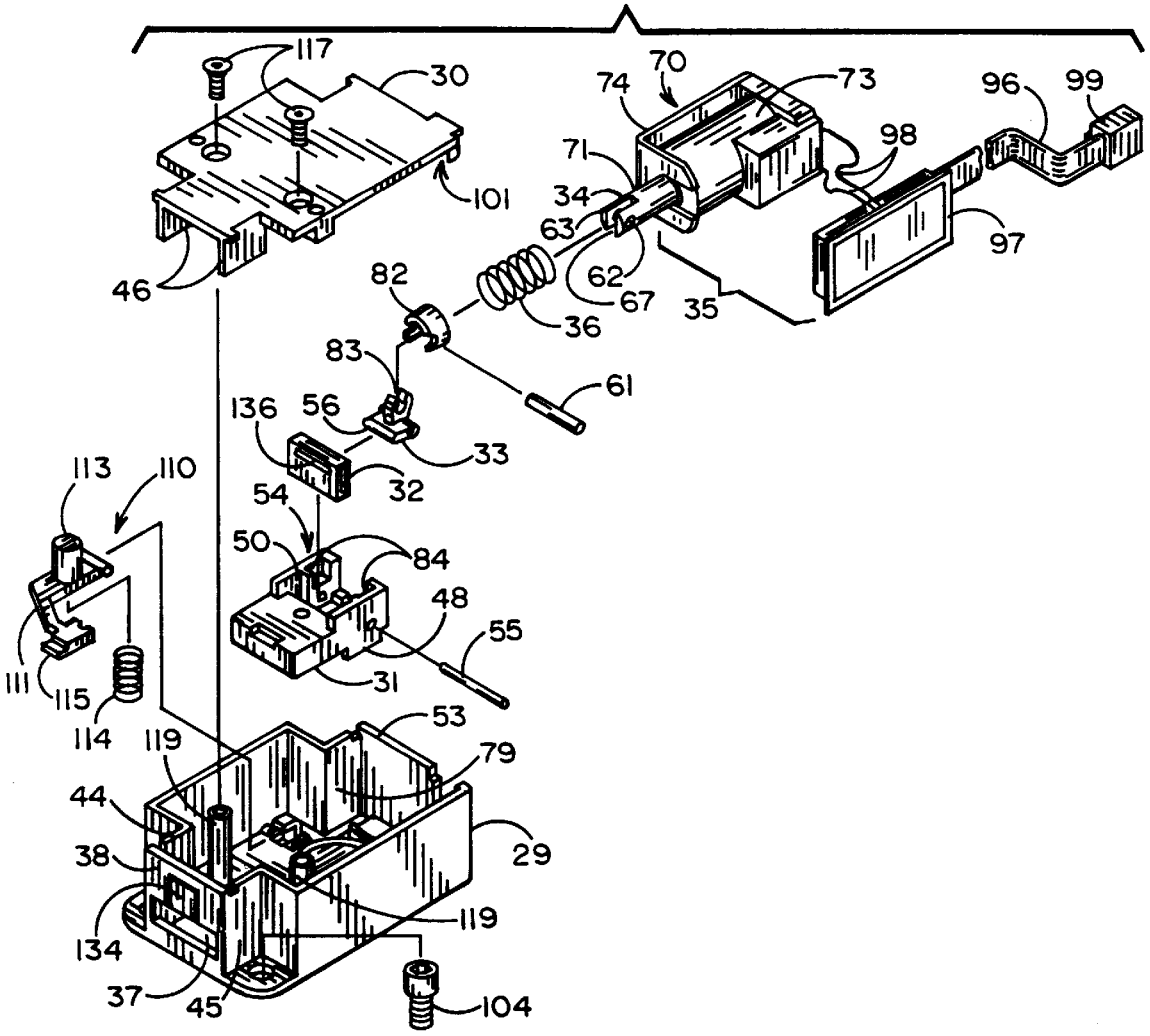

LOCK FOR SAFES AND OTHER SECURITY DEVICES

BACKGROUND OF THE INVENTION

This invention is concerned with locks and particularly locks for use on safes, vaults and other security devices.

Improvement of locks for safes and the like is an on going activity by lock designers and manufactures. As improvements are made to locks, safecrackers also improve there skills Accordingly, there is a need for more tamper resistant locks especially for locks for safes.

One improved electrically activated lock, disclosed in U.S. Pat. No. 5,249,831, uses a solenoid based system with the locking bolt biased towards its locked position. U.S. Pat. No. 5,249,831 is directed towards a lock having an inertially operated counterweight to prevent the spring biased locking bolt from being opened by a heavy blow to the safe designed to impart enough momentum to the locking bolt to overcome the force provided by the bias spring. While the lock of U.S. Pat. No. 5,249,831 improved the security of locks further improvements are needed to lower cost, improve ease of assembly and manufacture and increase safe security.

SUMMARY OF THE INVENTION

This invention provides and improved lock system having a gate means for latching the locking bolt in the locked position which is an improvement over known lock systems. The locks can replace any conventional mechanical safe combination locks having footprints similar to the locks of this invention. Improvements have also been made in the relock means. This invention provide locks without the above mentioned deficiencies and which are also inertially tamper resistant.

Accordingly, there is provided by the principles of this invention a lock suitable for use on a safe and other security devices and activatable for safe entry from outside the safe. Generally the lock has a case having an opening, and a locking bolt in a slidable relationship within the opening and moveable between a locked position and an unlocked position. Gate means is provided that is constrained in a slidable relationship with and by the locking bolt. The gate means prevents the locking bolt from moving out of the locked position when the lock is not activated for safe entry and provides inertial resistance.

The lock has camming means, which is pivotally attached to the locking bolt, for sliding or lifting the gate means relative to the locking bolt and for positioning the gate means to allow the locking bolt to move out of its locked position when the lock is not activated for safe entry. Shaft means is provided which is slidably linked to the camming means and slideably connected to the locking bolt. The shaft means first pivots the camming means relative to the locking bolt and then moves the locking bolt to the unlocked position. Drive means, which is activatable from outside the safe, is provided for driving the shaft means from a first position associated with the locked position to a second position associated with the unlocked position when the lock is activated for safe entry. Biasing means biases the shaft means to the first position which forces the locking bolt to its locked position when the lock is not activated for entry.

In one embodiment, the case includes an internal case extension which abuts a portion of the gate means, when the lock is not activated for safe entry, and prevents or obstructs the locking bolt from sliding towards the locked position. The camming means slides the gate means within the locking bolt to a position which will clear the internal case extension and allow the locking bolt moves towards its unlocked position.

In another embodiment, the slidable relationship in which the locking bolt moves between the locked position and the unlocked position is in a first direction, and the slidable relationship in which the gate means moves is in a second direction which is approximately perpendicular to the first direction. In one embodiment, the first direction is a straight line. In one embodiment, the second direction is a straight line relative to the locking bolt.

In still another embodiment, the slidable relationship in which the locking bolt moves between the locked position and the unlocked position is in a first direction, and the movement of the shaft means is in another direction which is approximately parallel to the first direction. In one embodiment, said first and said another directions are straight lines In a further embodiment, said another direction has approximately the same general axis as that of the first direction.

In one embodiment, the lock has a slambolt having means for removable attachment to the locking bolt and to the gate means. The slambolt has ramp means for driving the locking bolt towards the unlocked position when the ramp means engages a door jam of the safe. Removal of the slambolt returns the lock to its first or non-slambolt mode of operation.

In another embodiment, the case has a knockout section abutting the opening, and the lock is usable in a slambolt mode of operation upon attachment of a slambolt to the locking bolt and the gate means and removal of the knockout section. Thereafter the lock can be returned to its first or non-slambolt mode of operation by simply removing the slambolt.

In still another embodiment, the lock has first attachment means for removably attaching the case to an inside surface of the safe, and second attachment means for removably attaching a cover to the case. The second attachment means is designed with a fail strength which is less than the fail strength of the first attachment means, so that when an unauthorized force is applied to the case intended to cause the case to separate from the inside surface of the safe door, the second attachment means fails before the first attachment means fails. In this embodiment after the second attachment means fails it becomes much more difficult, if not impossible, to cause the first attachment means to fail.

In a further embodiment, the lock has relock means for preventing the locking bolt from reaching its unlocked position when the cover is displaced slightly away from its proper mounting position on the case. Complete removal of the cover from the case is not necessary. In yet a further embodiment, the relock means includes a lever pivotally mounted in the case, and lever biasing means for biasing the lever away from the inside surface of the case wall which is adjacent or abutting the safe door. Means dependent from the cover is provided for maintaining the lever in a non-engaging relationship with the locking bolt when the cover is properly attached to the case. However, when the cover is not properly attached to the case, which may occur upon tampering with the lock, said means dependent from the cover allows the biasing means to bias the lever so that it restrainingly engages the locking bolt so that the locking bolt is blocked or prevented from reaching its unlocked position.

In a further embodiment, the lock has means for maintaining the drive means in a fixed position relative to the case. In one embodiment, the drive means is also for constraining the shaft means to slidable movement in a straight line relative to the case.

In a still further embodiment, the lock has means inside the case for holding the shaft means in the second position for a predetermined short period of time upon reaching the second position and releasing the shaft means upon expiration of the predetermined short period of time. In one embodiment, the predetermined short period of time is from about 0.1 second to about 1 minute, in another embodiment the period is from about 1 second to about 30 seconds, and in a preferred embodiment about 3 seconds.

In one embodiment, the biasing means biases the shaft means in a direction away from the drive means.

In another embodiment, the drive means includes a solenoid and the shaft means is an armature associated with the solenoid. Means is provided for maintaining the solenoid in a fixed position relative to the case. The solenoid constrains the armature to slidable movement in a straight line relative to the case.

There is also provided by the principles of this invention a lock suitable for use on a safe or other security devices comprising a case having an opening; a locking bolt constrained by and in a slidable relationship within the opening in the case and moveable between a locked position and an unlocked position; and gate means, constrained in a slidable relationship by and with the locking bolt, for moving between a gated position and an ungated position. The gated position prevents or obstructs the locking bolt from moving out of its locked position, and the ungated position allows the locking bolt to move out of its locked position and towards its unlocked position.

The lock has camming means, pivotally attached to the locking bolt for pivoting the camming means between a secured position and an unsecured position, and for camming the gate means between its gated position and its ungated position. The secured position maintains the gate means in its gated position, and the unsecured position maintains the gate means in its ungated position.

A shaft means, slidably linked to the camming means and slideably connected to the locking bolt and moveable between an extended position and a retracted position, first pivots the camming means from its secured position to its unsecured position, and then retracts the locking bolt from its locked position to its unlocked position. The extended position maintains the camming means in its secured position, and the retracted position maintains the camming means in its unsecured position.

The lock includes drive means, activatable from outside the safe, which drives the shaft means from its extended position to its retracted position; and biasing means which biases the shaft means to its extended position. In one embodiment, means activatable from outside the safe is electric means having a keypad mounted on the outside of the safe door. Such electric means have all security codes, including for example the lock's short predetermined period of time to remain unlocked after inputting the correct opening code, the combination change codes, and the lock-out time associated with inputting a series of incorrect combinations, housed inside the case.

Other objectives, features, and advantages of this invention will become apparent to those skilled in the art upon consideration of the following detailed description and the accompanying drawings.

BRIEF DESCRIPTION OF THE DRAWINGS

FIG. 2 is a top, rear and side perspective view of the case assembly of FIG. 1 showing the case and cover with an electric connector extending therefrom.

FIG. 3 is an exploded view of the main components contained in the case assembly of FIG. 2.

DESCRIPTION OF THE PREFERRED EMBODIMENTS

Figure 1:
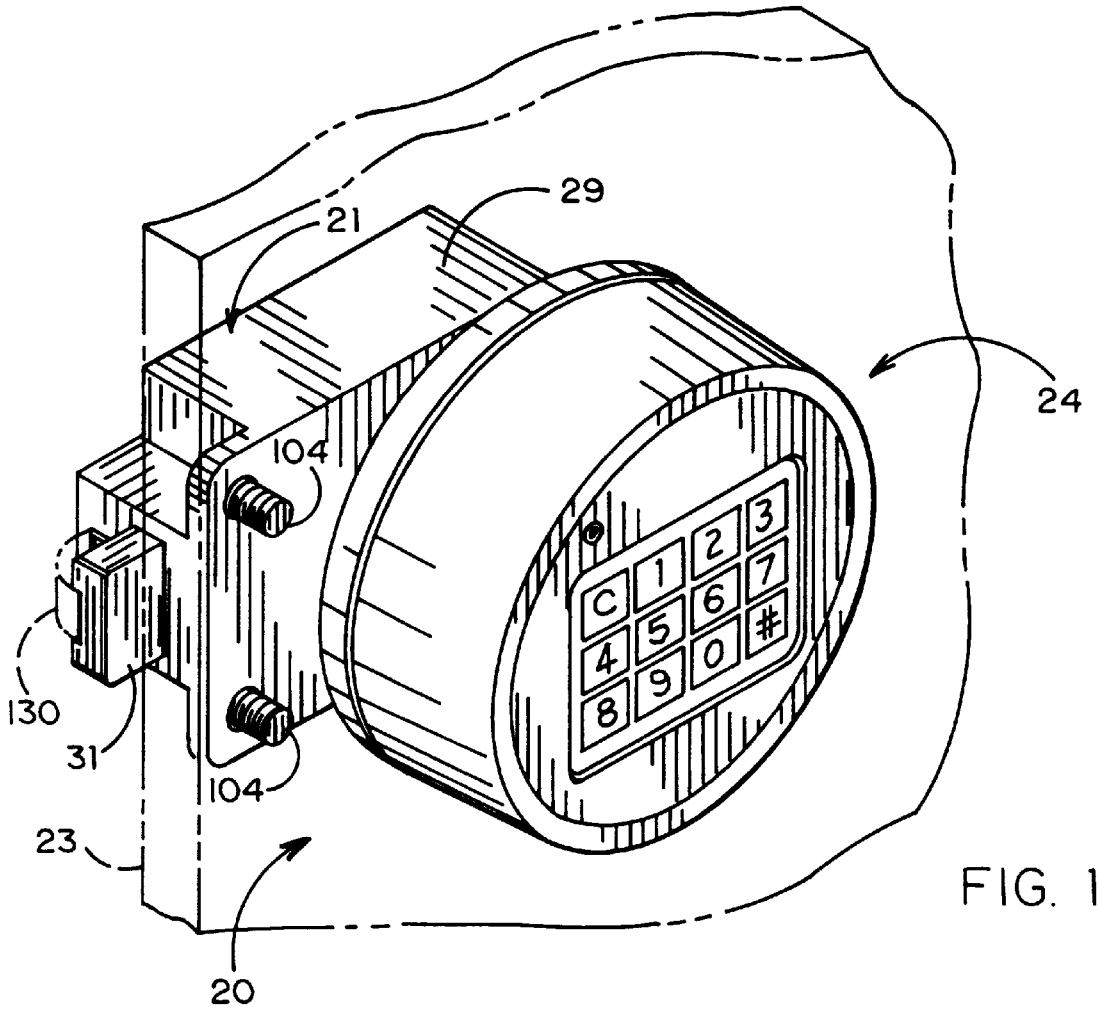
FIG. 1 is a front, top and side perspective view of an embodiment of my lock.
Figure 5:
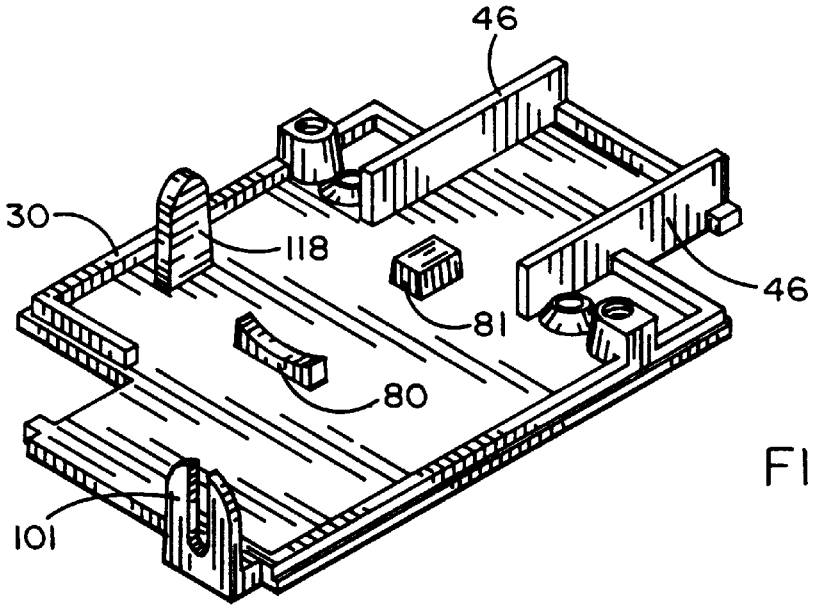
FIG. 5 is an enlarged view of the inside of the cover of FIG. 3 showing its internal and integral component support structure.
Figure 4:
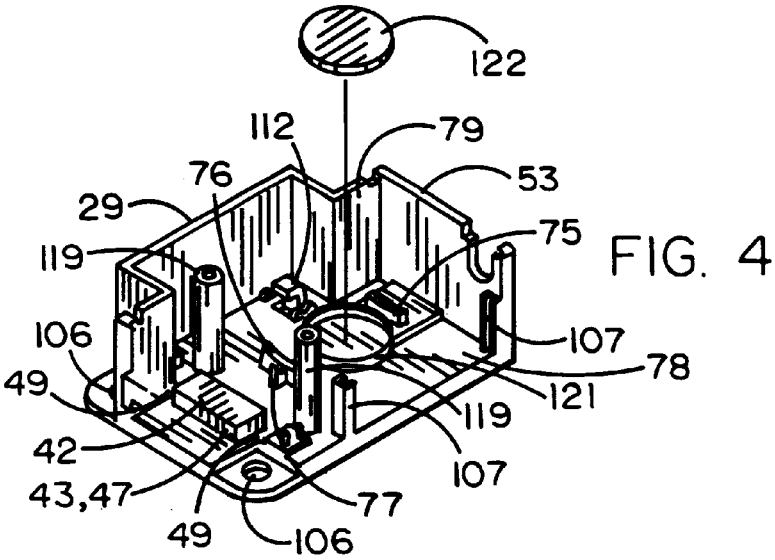
FIG. 4 is an inside view of the case shown in FIG. 3, with the top and the side walls partly broken away to show integral support structure and harden circular disk.
Figure 6:
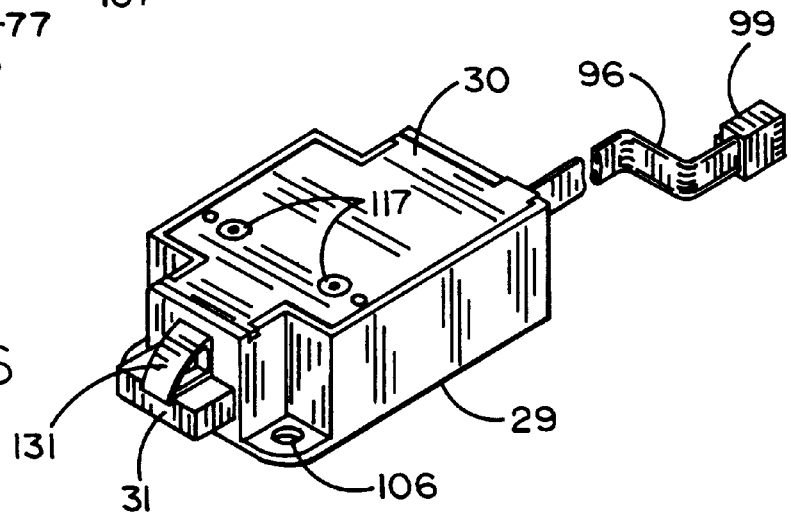
FIG. 6 shows another embodiment of the case assembly similar to FIG. 2 but with a slambolt installed.
Figure 10:
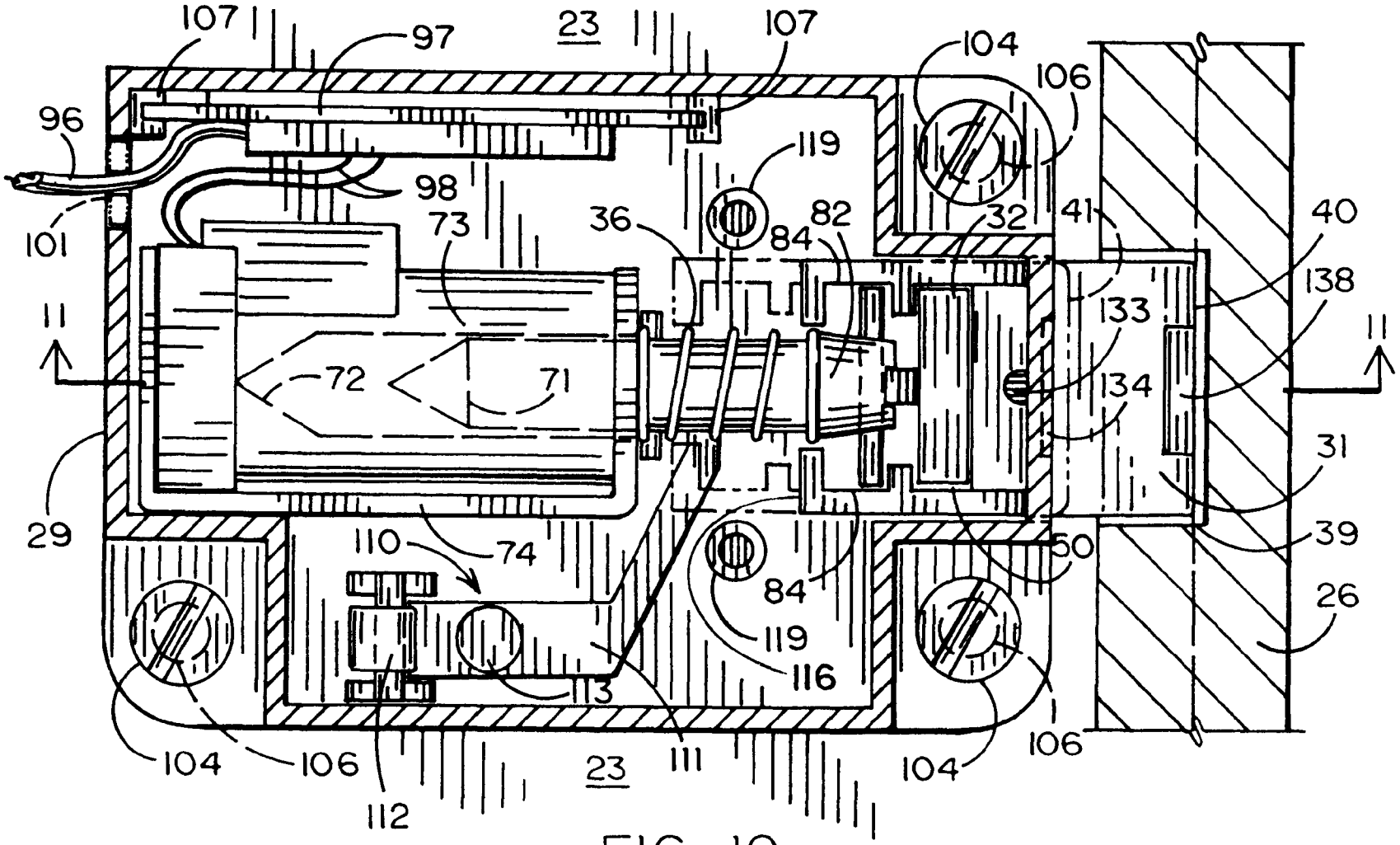
FIG. 10 is an enlarged rear view of the case and main components of FIG. 3 and a portion of the safe in which the lock is installed which shows the locking bolt in its locked position and, in phantom lines, its unlocked position.
Figure 11:
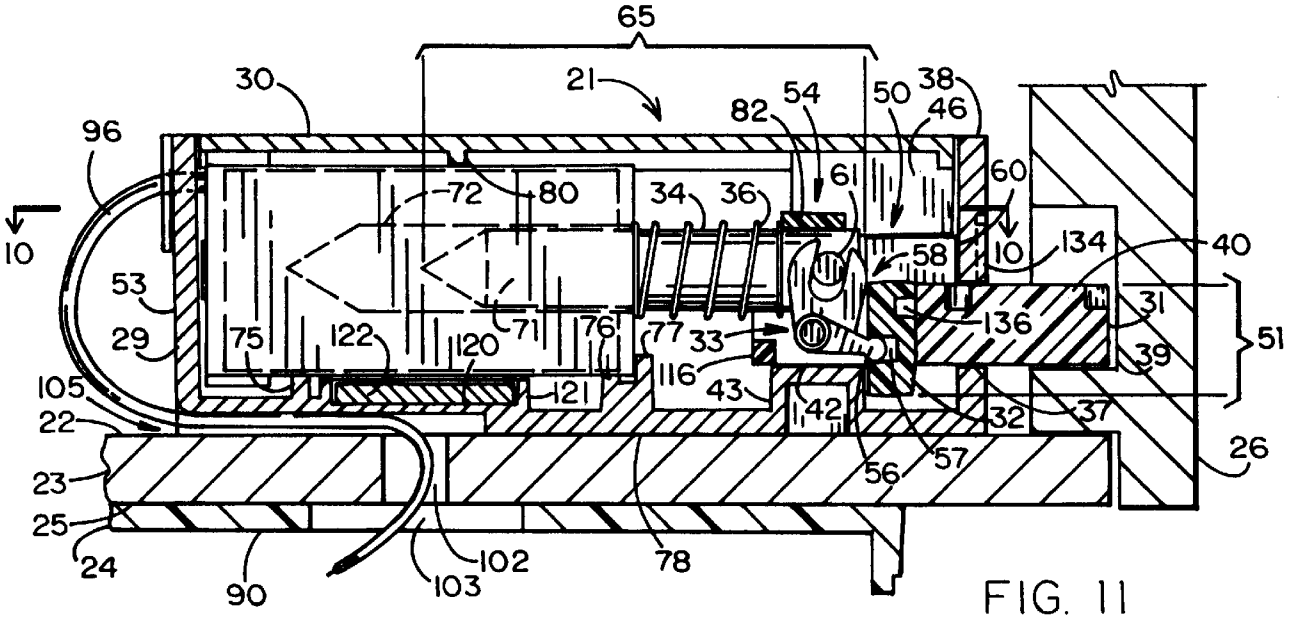
FIG. 11 is cross-sectional view nominally taken in the general direction of line 11—11 of FIG. 10 showing the locking bolt in its locked position.
Figure 14:
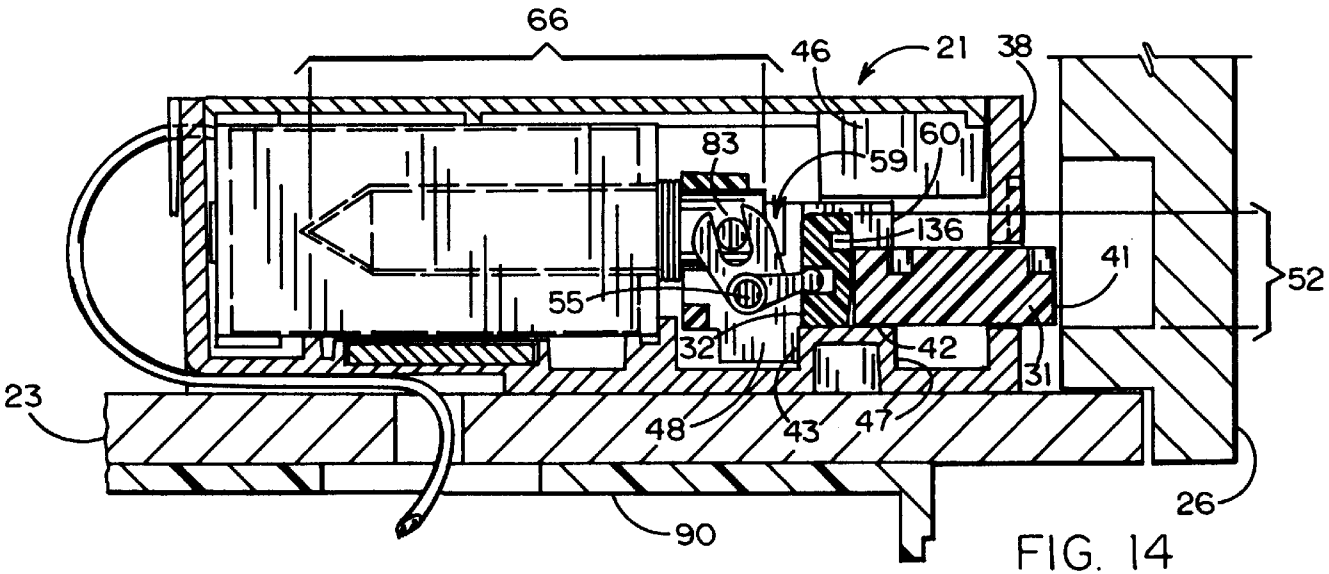
FIG. 14 is similar to FIG. 13 but shows the locking bolt as it reaches its unlocked position and the armature reaches its retracted position.
Figure 16:
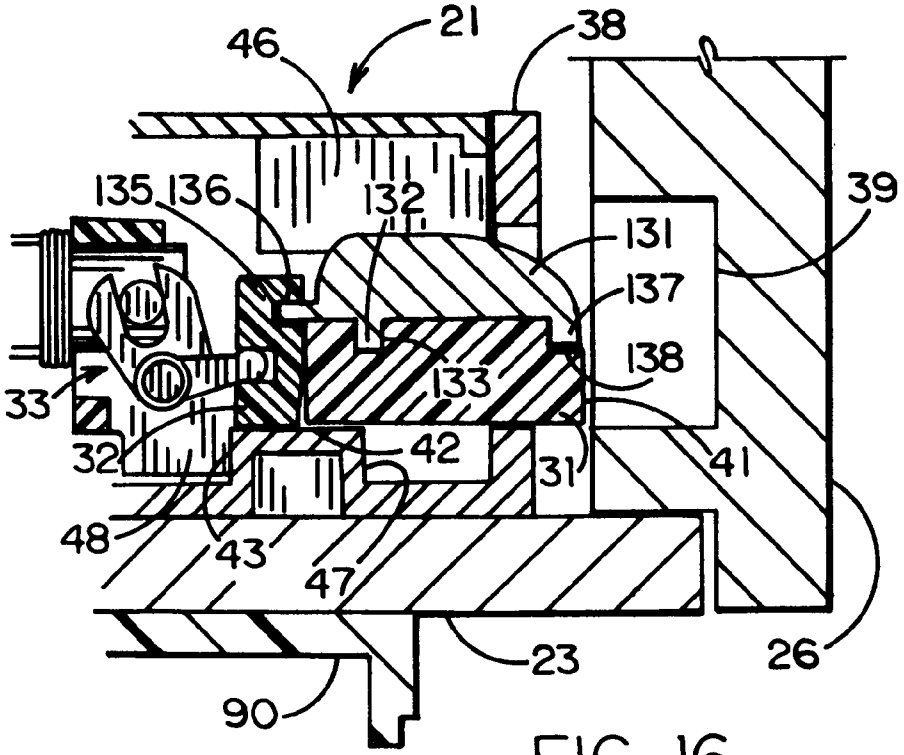
FIGS. 15–16, are similar to FIGS. 13–14 but show the lock in the slambolt mode of operation.
Figure 15:
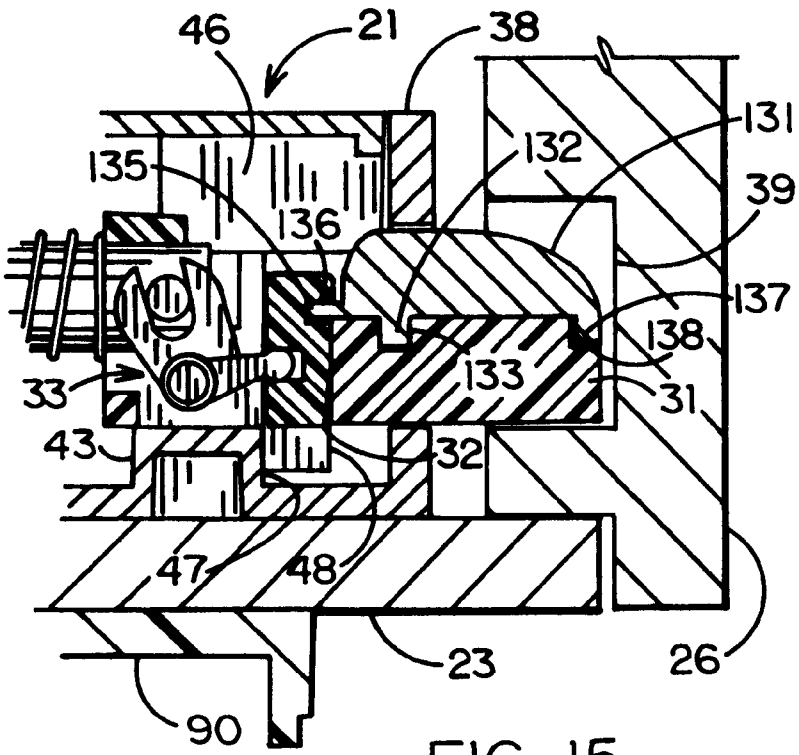

Referring to drawings, a lock for safes and other security devices, generally designated by 20, is shown in FIG. 1. The lock has an inner portion or case assembly 21 attached to the inside surface 22 (FIG. 11) of a door 23 of the safe or the like, and an outer portion or keypad assembly 24 attached to the outside surface 25 of door 23 approximately opposite to the case assembly. An adjacent wall 26 of the safe also serves as a door jamb as shown in FIGS. 10 and 11. Input of the correct predetermined combination to the keypad 27, sometimes referred to as the keypad membrane, will activate and unlock the lock by retracting locking bolt 31 as shown in FIG. 14.

Inner portion or case assembly 21 of a first or non-slambolt mode of operation is shown in FIG. 2. In this mode of operation the lock does not have a slambolt. The main mechanical components of case assembly 21 are shown in the exploded view illustrated by FIG. 3 and by cross-sectional views of FIGS. 10–14. The main mechanical components in case assembly 21 are case 29, cover 30, locking bolt 31, gate means 32, camming means 33, shaft means 34, and biasing means 36, and the main electrical component is electrical drive means 35 which includes solenoid assembly 70 and solenoid printed circuit board or solenoid PC board 97. When the safe is locked, locking bolt 31 extends through an opening 37 in case side wall 38 and engages a bolt recess 39 in adjacent safe wall 26 as seen in FIGS. 10–14.

Locking bolt 31 is constrained to slidable movement along a straight line within case 29, between a locked position 40 and an unlocked position 41, by opening 37, by a rearwardly facing surface 42 of an internal case extension 43, by guide tabs 48 of locking bolt 31 which straddle opposite sides 49 of internal case extension 43, by the inside surfaces of wall portions 44 and 45 of case 29, and by inwardly extending parallel ribs 46 of cover 30, as seen in FIGS. 3, 4, 5 and 10–14. Surfaces 60 of locking bolt 31 limit its maximum extension through opening 37 by abutting case side wall 38.

Figure 12:
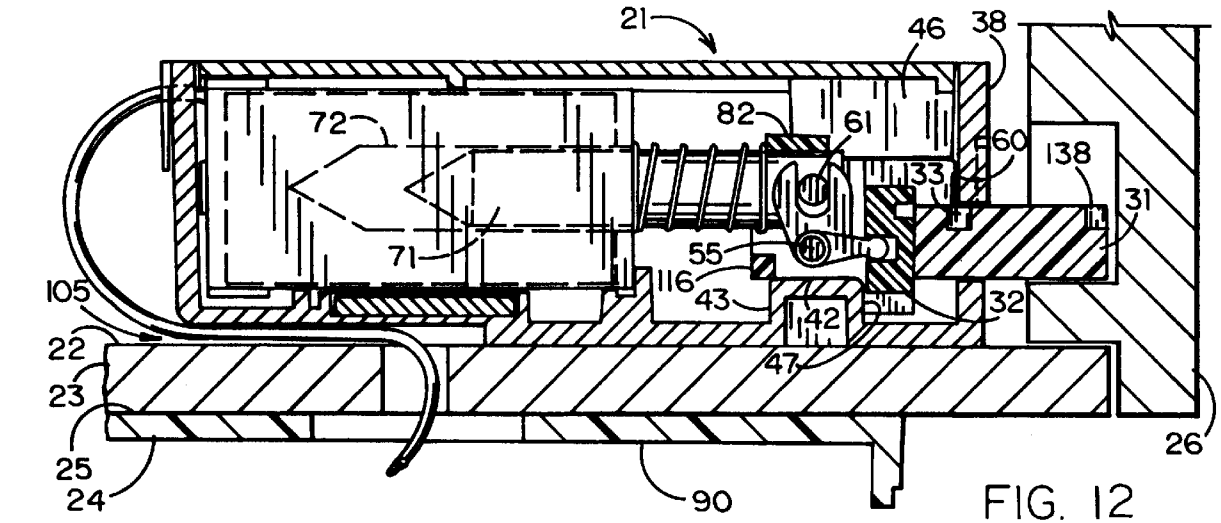
FIG. 12 is similar to FIG. 11 but shows the gate means as it begins to travel away from the front wall of the case and towards the cover.
Figure 13:
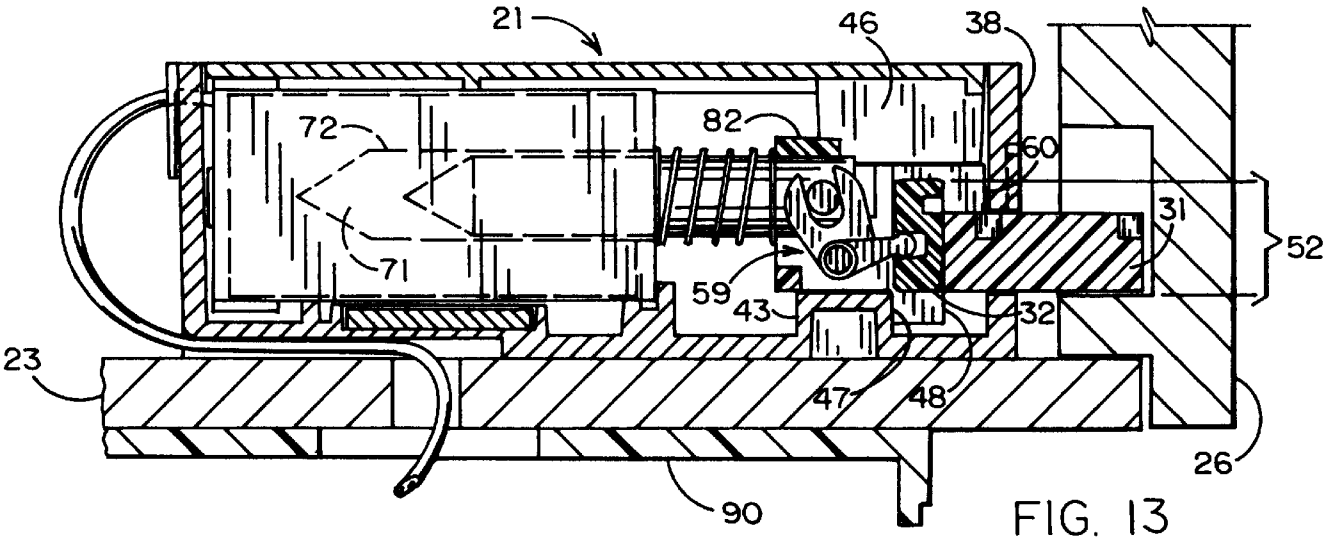
FIG. 13 is similar to FIG. 12 but shows the gate means when it first reaches its ungated position.

Gate means 32 is constrained in a slidable relationship by a gate channel 50 contained in locking bolt 31. Gate means 32 is slidable between a gated position 51 and an ungated position 52, as seen in FIGS. 11 and 14, respectively. In the gated position 51, an internal side face 47 of internal case extension 43 prevents gate means 32 from moving towards the far side wall 53 of case 29, which in turn prevents locking bolt 31 from moving out of its locked position 40 as shown in FIGS. 10–11. As seen in FIG. 12, gate means 32 is still partially gated or blocked by internal case extension 43. In the ungated position 52, however, locking bolt 31 is allowed to move out of its locked position 40 and towards its unlocked position 41, as illustrated by FIGS. 13–14.

Camming means 33, held at least partially within a cam recess 54 of locking bolt 31, is pivotally attached to the locking bolt by a cam-bolt pin 55. Camming means 33 contains a cam 56 which rest within a cam slot 57 in gate means 32. Camming means 33 is pivotable between a secured position 58 and an unsecured position 59, FIGS. 11 and 14, respectively. When in the secured position 58, cam 56 acts on cam slot 57 to maintain the gate means in the gated position 51 as seen in FIG. 11. When in the unsecured position 59 cam 56 acts on cam slot 57 to maintain gate means 32 in the ungated position 52 as shown in FIGS. 13–14. Camming means 33, therefore, cams gate means 32 between the gated position 51 and the ungated position 52 as shown in FIGS. 11–14.

Shaft means 34 is pivotally linked to the camming means 33 by a shaft pin 61 that is slidably mounted through a bore 62 in the distal split free end 63 of shaft means 34. Shaft means 34 is also slideably linked to locking bolt 31 by shaft pin 61 the ends of which are constrained within opposing internal recesses 64 of locking bolt 31 (FIG. 10). In this embodiment, shaft means 34 is slidable between an extended position 65 and a retracted position 66, as shown in FIGS. 11 and 14, respectively. Thus the travel of shaft means 34 pivots camming means 33 from its secured position(58 to the unsecured position 59, and retracts the locking bolt 31 from its locked position to its unlocked position 41. Therefore, when the shaft means 34 is in its fully extended position 65, camming means 33 is maintained in its secured position 58. When the shaft means 34 is in its retracted position 66, the camming means is maintained in its unsecured position 59.

Drive means 35 moves shaft means 34 from its extended position 65 to its retracted position 66. Drive means 35 preferably comprises a solenoid assembly 70 having an armature 71 deployed in the core cavity 10 72 of electrical portion or solenoid 73. In this embodiment, armature 71 serves as the shaft means. Solenoid assembly 70 has the plastic body of electrically insulated solenoid 73 mounted in a metal frame 74. Solenoid assembly 70 is maintained in a fixed position within the assembled case 21 by ribs 75, 76 and 77 which extend inwardly from the interior of a front case wall 78, by a bottom case wall portion 79 (FIG. 4), and by a rib 80 and an internal cover extension 81 which extend inwardly from cover 30. In particular, ribs 76 and 77, bottom case wall portion 79, and internal cover extension 81 all abut metal frame 74 of the solenoid assembly 70; and ribs 75, 76 and 80 all abut the plastic body of solenoid 73. Thus the solenoid assembly 70 is fixedly positioned with the case assembly 21, which in turn requires and constrains the armature 71 to slidable movement in a straight line relative to case assembly 21.

Biasing means for biasing the shaft means to the extended position is provided by a spring 36 mounted around armature 71.

Spring 36 abuts a plunger collar 82 also mounted around the armature and around shaft pin 61. As mentioned above, shaft pin 61 is retained by bore 62 in the split free end 63 of armature 71. Camming means 33 contains a U-shaped pin slot 83 which straddles a portion of shaft pin 61 that lies within the gap 67 between the split distal free end 63 of the armature 71.

Figure 7:
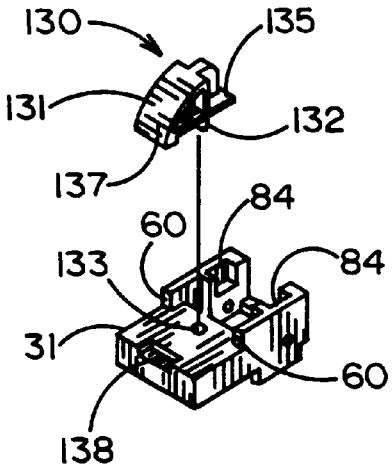
FIG. 7 is an explosive perspective view of the slambolt and locking bolt shown in FIG. 6.

Accordingly, when the solenoid is not moving the armature 71 towards the retracted position 66 or holding the armature for a short period of time in the retracted position, the biasing means or spring 36 extends the armature to the extended position 65. However, when the armature is in its retracted position 66, shaft pin 61, a portion of which is straddled by U-shaped pin slot 83 of camming means 33, causes the camming means to pivot to its unsecured position 59 which causes the gate means 32 to travel from its gated position 51 to its ungated position 52, while simultaneously the distal ends of shaft pin 61 slide within opposing interior recesses 84 of locking bolt 31 (FIGS. 3, 7 and 10) thereby causing locking bolt 31 to travel to its unlocked position 41. Therefore, when the solenoid is not moving the armature 71 towards the retracted position 66 or holding the armature in its retracted position, the biasing means or spring 36 drives the armature to the extended position 65 thereby pivoting camming means 33 into its secured position 58, which slides gate means 32 into its gated position 51, thereby maintaining locking bolt 31 in its locked position 40.

It can be seen that gate means 32, camming means 33, distal split free end 63 of shaft means 34, collar 82 and pin 61 all reside within recesses in the end of locking bolt 31 which is opposite of the tongue portion of the locking bolt 31 which extends through case opening 37.

Figure 8:
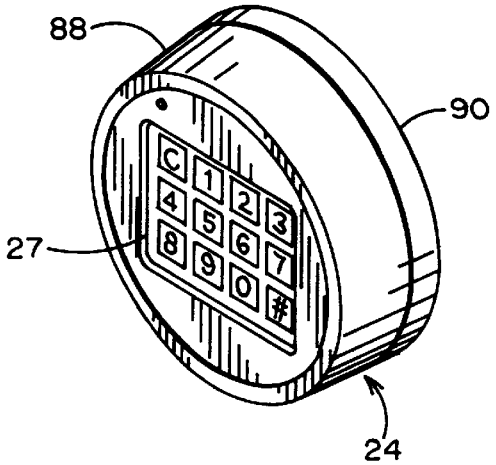
FIG. 8 is another side, top and front perspective view of keypad assembly show n FIG. 1.
Figure 9:
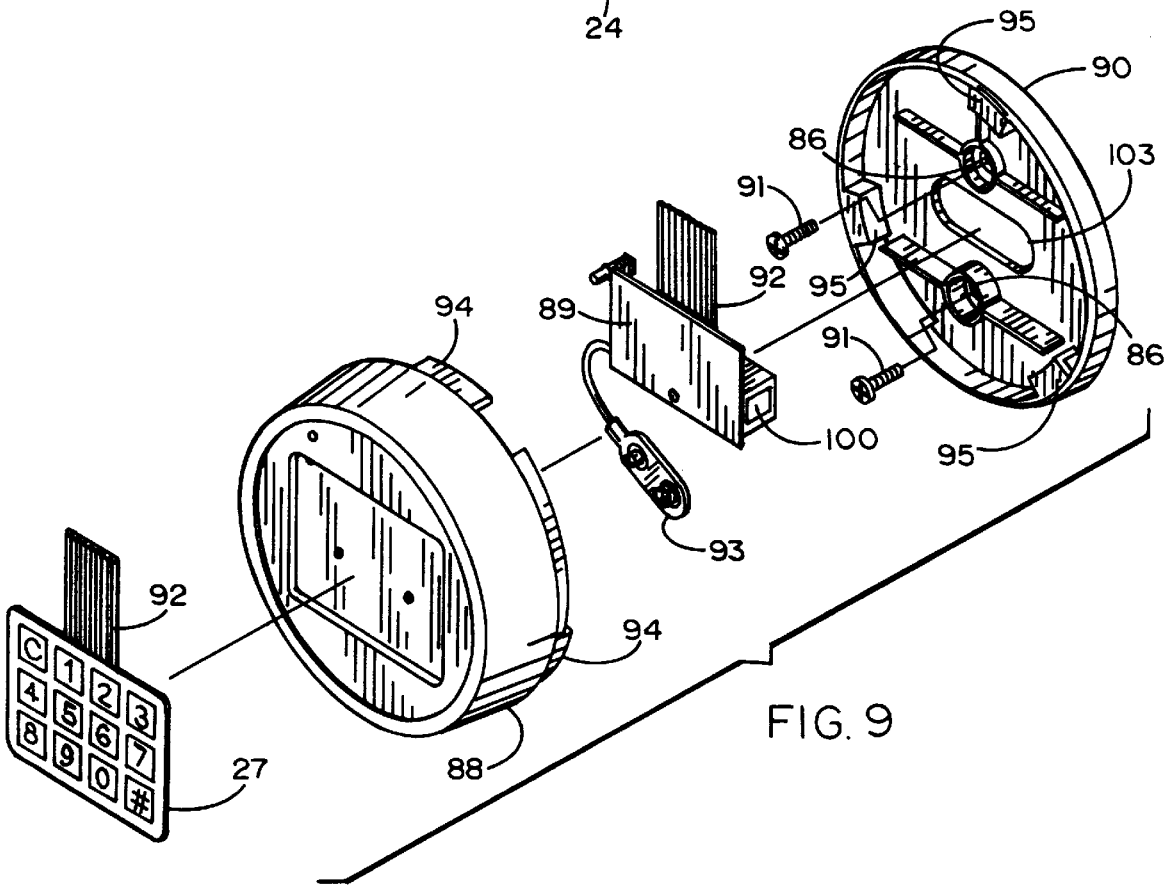
FIG. 9 is an explosive view of the keypad assembly shown in FIG. 8.

Focusing now on the components of the lock which are outside of the safe's interior, reference is made to keypad assembly 24 shown in FIG. 8, and the components therein which are shown explosively in FIG. 9. The main components are keypad membrane 27, removable front cover 88, keypad printed circuit board or keypad PC board 89, and base plate 90. Base plate 90 is mounted to the front of safe door by small screws 91 screwed through screw holes 86 into safe door 23. Keypad membrane 27 is attached to the inside of front cover 88 so that the number and letter codes can be activated by pressing them with the tip of a finger. An electrical connector 92 connects keypad membrane 27 to keypad PC board 89 which is also mounted inside cover 88. A small 9 volt battery mounted inside cover 88 (not shown in the drawing) and electrically connected to conventional battery terminal connector 93, supplies all the power required to operate the lock. Cover 88 is mounted to base plate 90 by inserting three spaced apart tabs 94 into three corresponding spaced apart sockets 95 in base plate 90 and rotating the cover through a small angle of about 20°.

A solenoid PC board 97 housed inside case assembly 21 is electrically connected to solenoid 73 by electrical connectors 98. Solenoid PC board 97 is electrically connected to keypad PC board by inserting plug 99 on the distal end of electrical connector 96 into an electrical socket 100 of keypad PC board 89. Electrical connector 96 is fed from case assembly 21 through an opening 101 in cover 30, then inserted through a connector opening 102 in safe door 23 (FIG. 11) and an opening 103 in base plate 90, and then plugged into socket 100. Case assembly 21 is then bolted into blind threaded holes (not shown) in the inside face of safe door 23 with bolts 104 inserted through case mounting holes 106 so that electrical connector 96 resides in a channel formed by the inside surface 22 of safe door 23 and a small elongated recess 105 in the exterior of the front case wall 78 of the case.

Also in accordance with the present invention, relock means is provided to prevent release of locking bolt 31 from its locked position 40 in the event the lock is tampered with by forcing a rod or other tool (not shown) through connector opening 102 (FIG. 11) in safe door 23 in an attempt either to dislodge the lock components from their mountings or to destroy the lock components. For this purpose relock means 110 (FIGS. 3, 4 and 10) is provided which comprises a lever 111 pivotally mounted to a bracket 112 which is preferably formed as an integral part of the interior of front wall 78 (FIG. 11) of case 29. Lever 111 contains a cup-shaped spring chamber 113 which retains therein a small spring 114 for biasing lever 111 internally away from the front case wall 78. Cover 30 contains a dependent relock rib 118 (FIG. 5) which abuts the closed distal end of spring chamber 113 keeping lever 111 depressed against front case wall 78 when cover 30 is properly mounted on case 29. When cover 30 is properly mounted on case 29, lever 111 is in an unrestraining relationship with the locking bolt. However, if dependent relock rib 118 of cover 30 is forced away from case 29, a shoulder 115 on the distal free end of lever 111 will be pivoted away from front case wall 78 and lodged against an edge 116 (FIGS. 10 and 11) of locking bolt 31 thereby preventing it from advancing to its unlocked position 41. By making the strength of cover 30 weak relative to the strength of case mounting bolts 104, if a tool is inserted through safe door connector opening 102 (FIG. 11), cover 30 will fail before bolts 104 fail. Therefore, when cover 30 fails, dependent relock rib 118 is forced away from case 29 and shoulder 115 of lever 111 engages edge 116 (FIGS. 10 and 11) of locking bolt 31 preventing it from advancing to its unlocked position 41 even if the gate means 32 should somehow be forced into its ungated position 52.

To mount cover 30 small screws 117 are inserted through the two holes in shown cover 30 and screwed into dependent threaded screw receiving posts 119 of case 29. The strength of small retaining screws 117 and posts 119 are also weak relative to the strength of case mounting bolts 104. Therefore, failure of any one of cover 30, screws 117 or post 119 will result in dependent relock rib 118 being dislodged slightly away from case 29 and allowing shoulder 115 to restrainingly engage edge 116 of locking bolt 31. Nevertheless in my preferred embodiment cover 30 is designed to fail before either screws 117 or posts 119 fail. These features make it very difficult, if not impossible, to cause bolts 104 to fail by inserting a tool through connector opening 102 in the safe door.

As a further means of preventing the lock from being opened by tampering intending to cause case bolts 104 to fail or case 21 to break away from the safe door 23, front case wall 78 has a section 120 (FIG. 11) of reduced thickness which is in line with safe door connector opening 102. If an attempt is made to render the lock ineffective by removing keypad assembly 24 and driving a rod, or drilling, or inserting another tool (not shown in the drawings), into the interior of the safe through safe door connector opening 102, such tools can readily break through section 120 and unseat solenoid assembly 70 and force it towards cover 30. Additional force on solenoid assembly 70 can unseat shaft pin 61 in bore 62 of armature 71 from U-shaped pin slot 83 of camming means 33 and break the relatively weak cover retaining screws 117, or dependent screw post 119, or cover 30 itself, thereby allowing cover 30 to become separated from case 29 which will cause shoulder 11 of relock means 110 to engage edge 116 of locking bolt 31 as described above.

As a still further means of preventing the lock from being opened by such tampering, section 120 of front case wall 78 has an inwardly directed annular boss 121 (FIGS. 4 and 11) into which a harden circular disk 122 is freely and rotatably housed. Disk 122 is held within boss 121 by abuttingly mounted solenoid assembly 70 which sandwiches disk 122 between the plastic body of solenoid 73 and the inside surface of front case wall 78. If a drill (not shown) is inserted through safe door connector opening 102, once the drill penetrates relatively weak section 120 it will engage freely rotatable disk 122 causing it to spin within boss 121 because of the difficulty of the drill biting into the harden disk, so that further destruction of the solenoid becomes more difficult and requires more force upon the drill thereby increasing the likelihood of failure of relatively weak cover 30 and as a consequence causing relock means 110 to restrainingly engage locking bolt 31.

Also in accordance with the present invention, solenoid PC board 97, which is housed within the safe by mounting in dependent brackets 107 extending from front case wall 78, is preprogrammed so that the once the correct combination is inputting through the keypad 27, the locking bolt 31 will be retracted for a short predetermined period of time and thereafter automatically released by the solenoid and returned to its locked position 40 by spring 36. This means that if the safe door is not closed within the predetermined period of time, the combination must be inputting again and the safe door closed within the predetermined period of time in order to lock the safe. For example, in a preferred embodiment the predetermined period of time is about 3 seconds which is enough time after the correct code has been inputting to the lock's keypad for one to close the safe's door.

Still further in accordance with the present invention, solenoid PC board 97 is preprogrammed so that the combination or code to unlock the safe can be changed if desired by inputting a change code through the keypad 27, followed by the old code and then inputting the new combination or code twice through the keypad. This eliminates costly and time consuming combination changes usually required to be made by a locksmith for most other locks.

Yet further in accordance with the present invention, solenoid PC board 97 is preprogrammed so that inputting four consecutive incorrect combination through the keypad will result in the lock being rendered inoperable for a predetermined period of time referred to as a "Penalty Lockout", for example 15 minutes. This prevents searching for the correct combination by unauthorized persons by use of automatic electronic code dialers that will input all possible combinations electronically over a period of a few hours. The delay of 15 minutes after each of four incorrect combinations means that such automatic dialers will take years to input all possible combinations.

Still further, means are provided to convert the lock from its previously described first or non-slambolt mode of operation wherein the locking bolt 31 must be retracted to the unlocked position 41 before the safe door can be closed and relocked, to a second or slambolt mode of operation in which the locking bolt 31 is cammed into its retracted position 66 when the safe door is closed and thereafter spring activated into locked position 40 by spring 36.

The slambolt mode of operation is illustrated in FIGS. 6, 7, 15 and 16 wherein a slambolt 130 with a camming surface 131 has a protruding post 132 and cleat 137 adapted to be fitted snugly into a post recess 133 and cleat notch 138 of locking bolt 31. Case side wall 38 has a knockout section 134 directly above and abutting locking bolt opening 37 which when removed permits the locking bolt with slambolt 130 fitted therein to be installed in case 29. Slambolt 130 also has an inwardly extending tab 135 which fits into a slambolt tab slot 136 on the opposite side of gate means 32 from the side containing cam slot 57. Tab 135 prevents gate means 32 from engaging internal case extension 43 of case 29. Thus when the slambolt 130 is installed in the locking bolt, gate means 32 can not move into a position similar to that shown in FIGS. 11 and 12.

After my lock is converted into the slambolt mode of operation, my lock can be quickly and easily returned to its first mode of operation by removal of slambolt 130 from locking bolt 31. An insert (not shown) can be installed in case side wall 38 where the knockout section had been if desired, however, it is not necessary to do so.

Although my lock is illustrated as mounted on a safe door to lock the door to a safe wall which serves as a door jamb, it is to be understood that my lock can also be employed to other locking arrangements known to those skilled in the art. For example, my lock can be used to lock a suitable bolt work mechanism (not shown) using multiple locking bolts to effect locking and unlocking of various security and other enclosures and devices.

Therefore, it will be appreciated that I have provided a novel lock useful for safes, other security devices and the like, utilizing a first or non-slambolt mode of operation featuring a spring biased locking bolt, with simple and yet highly reliable means to prevent unauthorized entry into such safes and other devices through the use of a locking bolt in combination with a gate means cammed between a secured position and an unsecured position. My lock also has a simplified relock means for preventing the lock from unlocking in the event the lock is tampered with. My lock further having the option of easy convertibility to a second or a slambolt mode;of operation from a first or non-slambolt mode of operation and vice versa.

While the preferred embodiments of the present invention have been described, various changes and modifications may be made thereto without departing from the spirit of the invention and the scope of the appended claims. The present disclosure and embodiments of this invention described herein are for purposes of illustration and example and modifications and improvements may be made thereto without departing from the spirit of the invention or from the scope of the claims. The claims, therefore, are to be accorded a range of equivalents commensurate in scope with the advances made over the art.

What is claimed is:

1. A lock suitable for use on a safe and activatable for safe entry from outside the safe comprising:

a case having an opening;

a locking bolt in a slidable relationship within the opening in the case and moveable between a locked position and an unlocked position;

gate means constrained in a slidable relationship by and with the locking bolt and operable, when the lock is not activated for safe entry, for preventing the locking bolt from moving out of the locked position;

camming means, pivotally attached to the locking bolt, for sliding the gate means relative to the locking bolt and for positioning the gate means to allow the locking bolt to move out of the locked position;

shaft means, slidably linked to the camming means and slideably connected to the locking bolt, for pivoting the camming means relative to the locking bolt and for moving the locking bolt to the unlocked position;

drive means activatable from outside the safe, for driving the shaft means from a first position associated with the locked position to a second position associated with the unlocked position when the lock is activated for safe entry; and biasing means for biasing the shaft means to the first position.

2. The lock of claim 1, wherein the case includes an internal case extension which abuts a portion of the gate means, when the lock is not activated for safe entry, and prevents the locking bolt from sliding towards the locked position.

3. The lock of claim 1, wherein the slidable relationship in which the locking bolt moves between the locked position and the unlocked position is in a first direction, and wherein the slidable relationship in which the gate means moves is in a second direction which is approximately perpendicular to the first direction.

4. The lock of claim 1, wherein the slidable relationship in which the locking bolt moves between the locked position and the unlocked position is in a first direction, and wherein the movement of the shaft means is in another direction which is approximately parallel to the first direction.

5. The lock of claim 1, further comprising first attachment means for removably attaching the case to an inside surface of the safe, and second attachment means for removably attaching a cover to the case, and wherein the cover has a fail strength which is less than a fail strength of the first attachment means, so that when an unauthorized force is applied to the lock intended to cause the case to separate from the inside surface, the cover fails before the first attachment means fails.

6. The lock of claim 5, further comprising relock means for preventing the locking bolt from reaching the unlocked position when the cover is displaced from the case.

7. The lock of claim 6, wherein the relock means includes a lever pivotally mounted in the case, and lever biasing means for biasing the lever away from the inside surface, and further comprising means dependent from the cover for Maintaining the lever in a non-engaging relationship with the locking bolt when the cover is securely attached to the case and for allowing the lever to restrainingly engage the locking bolt when the cover is not securely attached to the case so that the locking bolt is prevented from reaching the unlocked position.

8. The lock of claim 1, further comprising means for maintaining the drive means in a fixed position relative to the case.

9. The lock of claim 1, wherein the drive means is also means for constraining the shaft means to slidable movement in a straight line relative to the case.

10. The lock of claim 1, wherein the biasing means biases the shaft means away from the drive means.

11. The lock of claim 1, wherein the drive means comprises a solenoid and the shaft means is an armature associated with the solenoid, and further comprising means for maintaining the solenoid in a fixed position relative to the case, and wherein the drive means constrains the armature to slidable movement in a straight line relative to the case.

12. The lock of claim 11, further comprising activating means having a first portion for controlling the solenoid and which is mountable inside the safe, a second portion with an electric keypad for inputting a code to the first portion and which is mountable to the outside of the safe door, and an electrical connector connecting the first and second portions through a hole in the safe door, and wherein the first portion includes means for holding the solenoid in the second position for a predetermined short period of time upon reaching the second position and releasing the solenoid upon expiration of the predetermined short period of time.

13. A lock suitable for use on a safe comprising:

a case having an opening;

a locking bolt constrained in a slidable relationship within the opening in the case and moveable between a locked position and an unlocked position;

gate means, constrained in a slidable relationship by and with the locking bolt, for moving between a gated position and an ungated position, the gated position preventing the locking bolt from moving out of the locked position, and the ungated position allowing the locking bolt to move out of the locked position and towards the unlocked position;

camming means, pivotally attached to the locking bolt, for camming the gate means between the gated position and the ungated position, and for pivoting between a secured position and an unsecured position, the secured position maintaining the gate means in the gated position, and the unsecured position maintaining the gate means in the ungated position;

shaft means, slidably linked to the camming means and slideably connected to the locking bolt, for moving between an extended position and a retracted position, for pivoting the camming means from the secured position to the unsecured position, and for retracting the locking bolt from the locked position to the unlocked position, the extended position maintaining the camming means in the secured position, and the retracted position maintaining the camming means in the unsecured position;

drive means activatable from outside the safe, for driving the shaft means from the extended position to the retracted position; and biasing means for biasing the shaft means to the extended position.

14. The lock of claim 13, wherein the case includes an internal case extension which abuts a portion of the gate means, when the lock is not activated for safe entry, and prevents the locking bolt from sliding towards the locked position.

15. The lock of claim 13, wherein the slidable relationship in which the locking bolt is constrained to move between the locked position and the unlocked position is in a first direction, and wherein the slidable relationship in which the gate means is constrained to move with respect to the locking bolt is in a second direction which is approximately perpendicular to the first direction; and wherein the movement of the shaft means is in a direction which is approximately parallel to the first direction.

16. The lock of claim 13, further comprising first attachment means for removably attaching the case to an inside surface of the safe, and second attachment means for removably attaching a cover to the case, wherein the cover has a fail strength which is less than a fail strength of the first attachment means, so that when an unauthorized force is applied to the lock intended to cause the case to separate from the inside surface, the cover fails before the first attachment means fails; and relock means for preventing the locking bolt from reaching the unlocked position when the cover is displaced from the case, wherein the relock means includes a lever pivotally mounted in the case, and lever biasing means for biasing the lever away from the inside surface, and means dependent from the cover for maintaining the lever in a non-engaging relationship with the locking bolt when the cover is securely attached to the case and for allowing the lever to restrainingly engage the locking bolt when the cover is not securely attached to the case.

17. In a lock suitable for use on a safe and activatable for safe entry from outside the safe, the lock having a case, a locking bolt slidable through an opening in the case and moveable between a locked position and an unlocked position, drive means for driving, shaft means slideably connected to the locking bolt, and biasing means for biasing the shaft means to a first position associated with the locked position, the improvement comprising:

gate means constrained in a slidable relationship by and with the locking bolt and operable, when the lock is not activated for safe entry, for preverting the locking bolt from moving out of the locked position; and camming means, wherein the shaft means is slidably linked to camming means, and the camming means is pivotally attached to the locking bolt, the camming means for sliding the gate means relative to the locking bolt and positioning the gate means to allow the locking bolt to move out of the locked position when the lock is activated for safe entry.

* * * * *